US007832958B2

(12) United States Patent
Veldboom et al.

(10) Patent No.: US 7,832,958 B2
(45) Date of Patent: Nov. 16, 2010

(54) SWING-OUT MANHOLE COVER

(75) Inventors: Lee M. Veldboom, East Jordan, MI (US); Kevin S. Vrondran, East Jordan, MI (US); Jeremy I. Johnson, East Jordan, MI (US)

(73) Assignee: East Jordan Iron Works, Inc., East Jordan, MI (US)

( * ) Notice: Subject to any disclaimer, the term of this patent is extended or adjusted under 35 U.S.C. 154(b) by 449 days.

(21) Appl. No.: 11/945,725

(22) Filed: Nov. 27, 2007

(65) Prior Publication Data

US 2008/0063471 A1 Mar. 13, 2008

Related U.S. Application Data

(63) Continuation-in-part of application No. 11/420,083, filed on May 24, 2006, now Pat. No. 7,341,398.

(51) Int. Cl.
*E02D 29/14* (2006.01)

(52) U.S. Cl. ..... 404/25

(58) Field of Classification Search ..... 404/25; 137/371; 52/19
See application file for complete search history.

(56) References Cited

U.S. PATENT DOCUMENTS

| | | | | |
|---|---|---|---|---|
| 1,225,679 | A * | 5/1917 | Ransehousen | 220/210 |
| 1,314,306 | A * | 8/1919 | Cullison | 220/86.2 |
| 2,439,978 | A * | 4/1948 | Konchan | 70/455 |
| 3,262,227 | A * | 7/1966 | Pentecost | 49/354 |
| 4,015,373 | A * | 4/1977 | Boissier | 52/20 |
| 4,456,397 | A * | 6/1984 | Freis et al. | 404/25 |
| 5,531,541 | A * | 7/1996 | Clover et al. | 404/25 |
| 7,341,398 | B2 * | 3/2008 | Johnson et al. | 404/25 |
| 7,695,213 | B1 * | 4/2010 | Akkala et al. | 404/25 |
| 2008/0138153 | A1 * | 6/2008 | Johnson et al. | 404/26 |

* cited by examiner

*Primary Examiner*—Gary S Hartmann
(74) *Attorney, Agent, or Firm*—Warner Norcross & Judd LLP

(57) ABSTRACT

A swing-out manhole cover assembly having at least one ramp to facilitate opening and closing the cover. The manhole cover assembly includes a frame, a cover, a swing assembly and at least one ramp. As the cover swings open away from the frame about the swing assembly, the ramp imparts linear translation to the cover separating the cover from the frame slightly. As the cover swings back to close the manhole cover, the ramp reverses the linear translation and the cover returns back to the frame. A spring may be included to bias the cover in the closed position.

8 Claims, 7 Drawing Sheets

SWING-OUT MANHOLE COVER

RELATED APPLICATION

The present application is a continuation-in-part of U.S. application Ser. No. 11/420,083, which was filed on May 24, 2006 (now U.S. Pat. No. 7,341,398).

BACKGROUND OF THE INVENTION

The present application relates to manhole covers, and, more particularly, to a swing-out manhole cover.

Manhole covers are well-known and widely utilized. Generally, a manhole cover provides access for maintenance of infrastructure, for instance wiring or piping. Traditional manhole cover assemblies include a frame that is attached to the substructure housing infrastructure to be maintained. Examples of such substructure include the base for a road or sidewalk. The manhole cover may be locked for security or sealed leak-tight to prevent infiltration of external contaminants. The cover in a traditional manhole cover assembly is lifted up and away from the frame to gain access to the infrastructure. Because manhole covers are predominantly made of iron and can weigh often in excess of 100 pounds, the effort required to lift a manhole cover can be difficult and even injurious to the operator.

Spring-assisted manhole covers have been developed to lessen the effort required to open the cover. In a typical spring-assist manhole cover, the manhole cover is hinged to the frame such that the cover is rotated up and away from the frame. For example, with a horizontally oriented frame, the cover rotates upwardly in a vertical direction. In one particular pre-existing construction, torsion springs are installed on opposite sides of the hinge to assist in the lifting. One end of each of the torsion springs is secured in a hole in the cover, and the other end is fixed in a hole in the frame. This configuration does provide assistance in lifting the manhole cover, but may not be suitable for use in pressurized applications where holes in the cover and frame are prohibited. Also, this configuration is only suitable in locations where there is enough vertical clearance above the frame for the diameter of cover to rotate through. This system can be more expensive than other systems because of the cost associated with the torsion springs and their installation.

The above shortcomings can be amplified when the site for the manhole is elevated above ground level. An example of such an application is when an access portal is desired in above-ground pipelines. Lifting an elevated cover can be more difficult than lifting a ground-level cover because typically less lifting leverage can be obtained due to the relative height of the cover to the operator.

SUMMARY OF THE INVENTION

The present invention provides a swing-out manhole cover assembly with at least one ramp to assist with opening and closing the cover. In one embodiment, the manhole cover assembly includes a cover, a frame, a ramp and a swing assembly. The swing assembly rotatably connects the cover to the frame allowing it to be rotated out of the opening in frame. As the cover is rotated out of the opening about the swing assembly, the ramp imparts linear translation to the cover, separating the cover from the frame slightly to provide clearance between the cover and the frame.

In one embodiment, the cover and frame each include a ramp. As the cover swings out, the cover ramp rides up the frame ramp separating the cover from the frame slightly allowing the cover to swing open more easily. As the cover swings back in toward the frame, the cover ramp rides down the frame ramp bringing the cover back down to the frame.

In one embodiment, the frame also includes a support flange, a frame wall and a cover support rim. The support flange is connected to or otherwise supported by the substructure. The frame wall extends from the support flange and away from the substructure. The cover support rim extends from the free edge of the frame wall to form a surface for supporting the cover. In this embodiment, the frame ramp projects from the frame wall inwardly toward the center of the frame. In one embodiment, the exterior face of the frame ramp slopes down toward the substructure as the frame ramp moves toward the center of the frame away from the frame wall. In one embodiment, the cover ramp extends from the interior face of the cover. In one embodiment, the slope of the face of cover ramp is equal to the slope of the exterior face of the frame ramp.

In one embodiment, the swing assembly includes a pivot post. In this embodiment, the pivot post may be threadedly secured to the cover and rotatably received into the frame ramp. The cover and pivot post rotate with respect to the frame as the cover swings away from the frame. In one embodiment, the pivot post may be mounted to the cover within a generally cylindrical boss and the boss may be angled to define the cover ramp. Similarly, the pivot post may be mounted to the frame within a boss. The frame boss and the cover boss may have complimentary angled surfaces that function as the frame ramp and cover ramp, interacting to raise and lower the cover slightly as the cover is rotated about the swing assembly.

In one embodiment, the manhole cover assembly includes a spring to bias the cover in a closed position. In a further embodiment, the manhole cover assembly includes a seal to provide a leak-tight joint between the frame and the cover. In still a further embodiment, the manhole cover assembly includes a locking mechanism to prevent unauthorized access to the infrastructure through the manhole.

The present invention provides a swing-out manhole cover assembly that requires reduced effort to open and close the cover. The swing-out manhole cover assembly also requires less clearance above the cover assembly to operate than prior flip-up designs. The invention accomplishes these achievements with minimal additional cost and with relatively simple components that are likely to operate reliably in the field. Further, the present invention may include a spring-element that biases the cover in the closed position.

These and other objects, advantages, and features of the invention will be readily understood and appreciated by reference to the detailed description of the current embodiment and the drawings.

DESCRIPTION OF THE CURRENT EMBODIMENT

Figure 1:
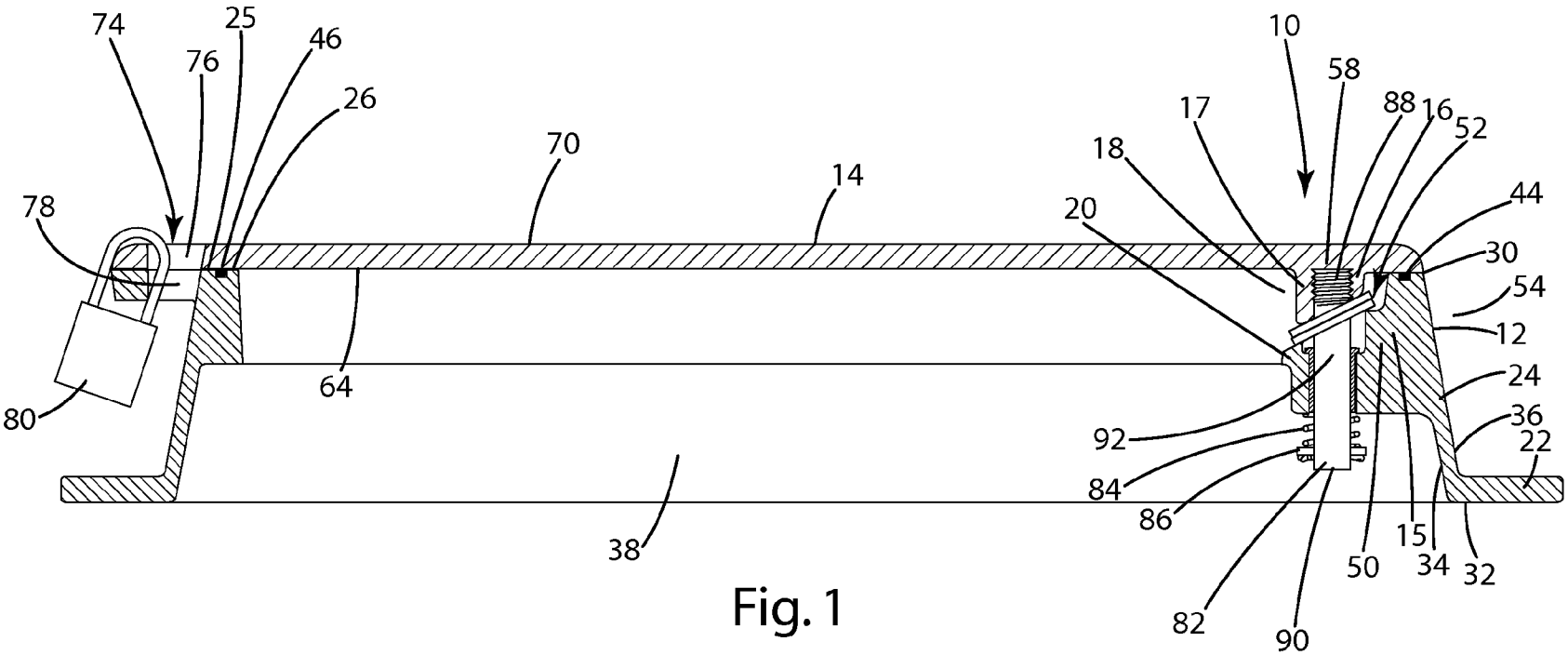
FIG. 1 is a cross-section view of the swing-out manhole cover assembly.

A swing-out manhole cover assembly in accordance with an embodiment of the present invention is illustrated in the drawings and generally designated 10. In the embodiment illustrated in the figures, the manhole cover assembly 10 includes a frame 12 defining an opening 38, a cover 14 of sufficient size to cover the opening 38, a cover ramp 18, a frame ramp 20 and a swing assembly 16. The swing assembly 16 rotatably connects the cover 14 to the frame 12 to permit the cover 14 to be selectively rotated out of the frame opening 38. As the cover 14 is rotated away from the opening 38 about the swing assembly 16, the cover ramp 18 and the frame ramp 20 interact to impart linear movement to the cover 14 slightly separating the cover 14 from the frame 12. This separation provides clearance between the cover 14 and the frame 12 to, among other things, ease movement of the cover 14.

The present invention is illustrated in connection with a specific circular manhole frame and circular manhole cover construction. The present invention is, however, well-suited for use with manhole constructions of other types, shapes and sizes. The illustrated embodiment includes a frame ramp and a cover ramp, but the present invention may include only a single ramp, if desired.

I. Frame

As noted above, the swing-out manhole cover assembly 10 includes a frame 12 supported on the substructure housing the infrastructure to be maintained. The frame 12 is generally peripheral defining a central opening 38 of sufficient size to permit access to the underlying infrastructure. In the illustrated embodiment, the frame 12 includes a support flange 22, a frame wall 24, a cover support rim 26 and a frame ramp 20.

The frame 12 may be mounted to the substructure in any suitable manner, including essentially any conventional mounting construction. Accordingly, the substructure and installation of the frame 12 will not be described in detail. Suffice it to say that the support flange 22 may be mounted to the substructure housing the infrastructure to be maintained or directly to the infrastructure itself. The substructure may be a pipeline. The flange 22 can be configured to fasten to essentially any type of substructure including tanks, conduits, etc. In the illustrated embodiment, the flange 22 is an annular rim, but the flange 22 could alternatively be any geometry adapted for connection to a particular substructure. The flange 22 could have mounting holes, slots, tabs, brackets or any other means for attachment to the substructure.

Figure 2:
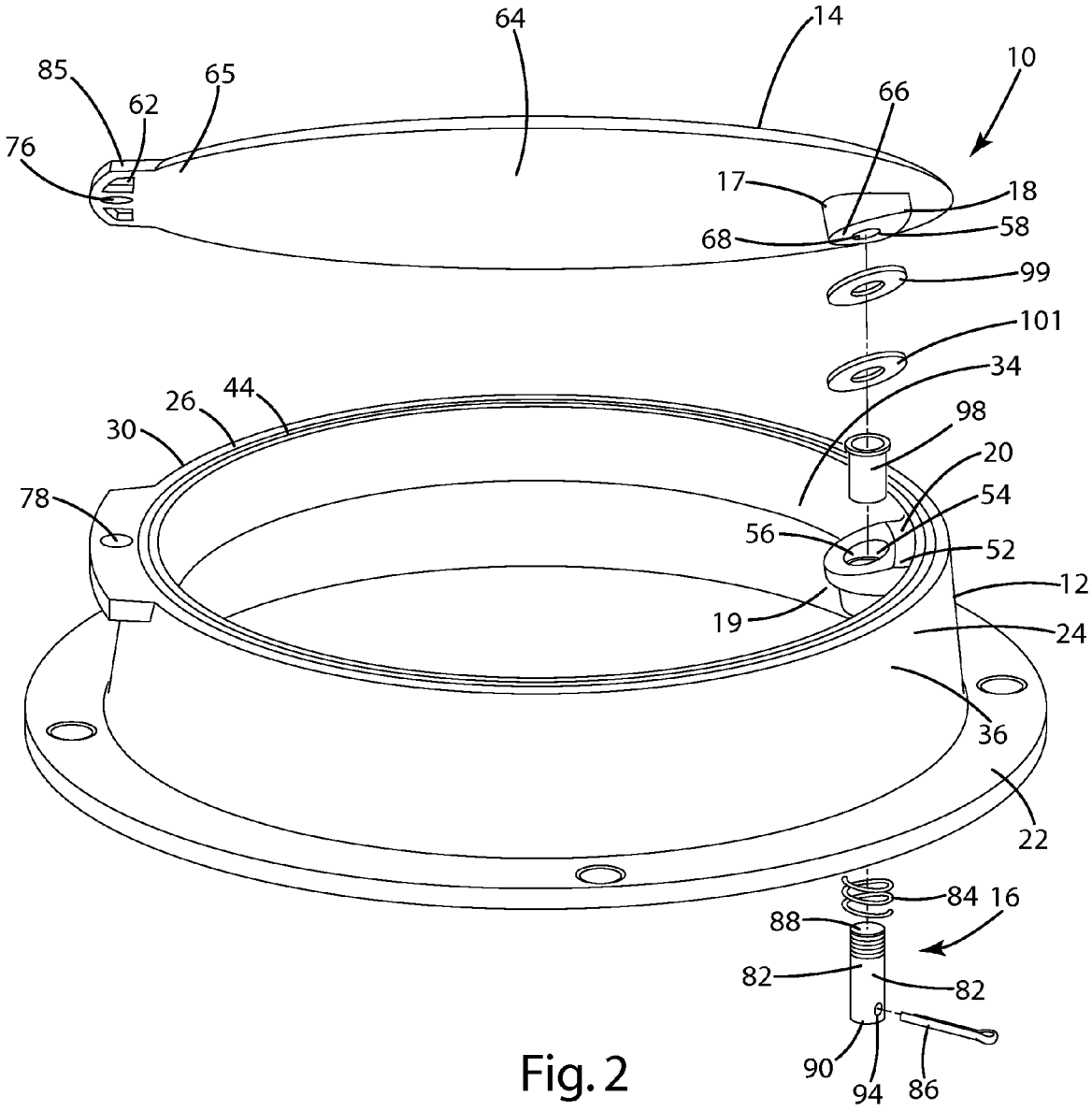
FIG. 2 is an exploded perspective view of the swing-out manhole cover assembly.
Figure 3:
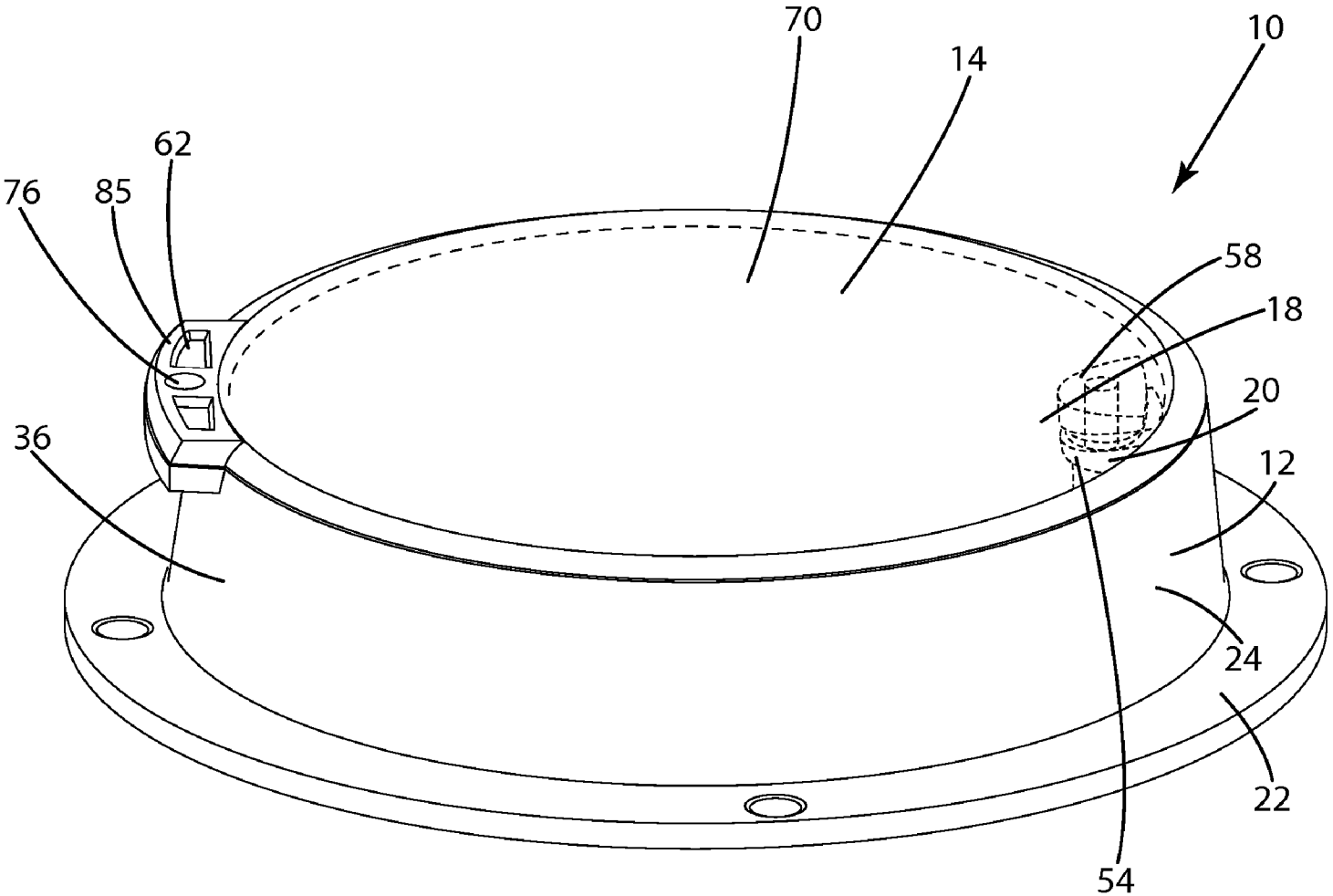
FIG. 3 is a perspective view of a closed swing-out manhole cover assembly showing the cover ramp and frame ramp in phantom.

In the embodiment depicted in the figures, the frame wall 24 includes a first end 30, a second end 32, an interior surface 34 and an exterior surface 36. The second end 32 abuts the flange 22. The frame wall 24 extends away from the flange 22. As shown in FIG. 2, the illustrated frame wall 24 angles inwardly toward the interior of the opening 38 of the frame 12 as the wall 24 extends away from the flange 22. In other words, the radius of the opening 38 decreases away from the flange 22. In other embodiments, the frame wall 24 could extend perpendicularly to the flange 22 or angle outwardly as the wall 24 extends from the flange 22. The interior surface 34 of the frame wall 24 faces toward the interior 38 of the frame 12.

As shown in FIG. 1, the second end 32 of the frame wall 24 terminates in the outer face 25 of the frame 12. In this embodiment, the outer face 25 defines the cover support rim, which is adapted to receive and support the cover 14. The cover support rim 26 may project inwardly from the interior surface 34 of the frame wall 24 to provide a broader surface for receiving the cover 14. As shown, the cover support rim 26 of the illustrated embodiment is a generally annular ring extending parallel to the plane of the support flange 22. The cover support rim 26 need not extend parallel to the plane of the support flange 22. For example, the cover support rim 26 may extend at an angle to the flange 22 to compensate for angled substructure or to provide an angled cover 14. The present invention is well-suited for use in leak-tight constructions. To facilitate a leak-tight construction, the cover support rim 26 may have a seal receiving channel 44 circling the cover support rim 26. The channel 44 may be configured to receive a seal 46, such as a conventional o-ring seal. The seal need not be a conventional o-ring seal, but could be essentially any suitable alternative seal. If desired, the seal may be replaced by a gasket (not shown), thereby eliminating the need for a seal receiving channel.

In the embodiment of FIGS. 1-5A, the frame 12 may include a frame boss 19 configured to operatively interconnect with the swing assembly 16. The boss 19 of the illustrated embodiment is an essentially cylindrical projection extending inwardly from the interior surface 34 of the frame wall 24. The boss 19 defines a through bore or frame post hole 54. The frame boss 19 includes an interior face 50 facing the substructure upon which the frame 12 is mounted. The frame boss 19 also includes an exterior face 52 facing the cover 14 when the cover 14 is in the closed position over the frame 12. In the illustrated embodiment, the exterior face 52 of the frame boss 19 is configured to define the frame ramp 20. More specifically, the exterior face 52 is angled downwardly and inwardly toward the center of the frame 12. In one embodiment, the exterior face 52 of the frame ramp 20 may have a slope in a range between 20° to 25°. In the illustrated embodiment, the frame post hole 54 seats the pivot post 82 (described in more detail below) and extends from the exterior face 52 of the frame ramp 20 down to the interior face 50 of the frame ramp 20. The frame post hole 54 may extend in a direction perpendicular to the plane of the cover support rim 26. The inner surface 56 of the frame post hole 54 may be substantially smooth to provide a surface that facilitates rotation of the cover 14.

Although the illustrated embodiment includes a frame ramp, the frame ramp is not strictly necessary. In an alternative embodiment, the frame does not include a frame ramp. Instead, some portion of the frame or a projection therefrom is disposed adjacent to the cover ramp so as to interface with the cover ramp 18 as the cover 14 swings with respect to the frame 12.

The frame 12 may be cast from iron, but alternative materials and fabrication methods providing suitable performance could also be utilized.

II. Cover

As described above, the manhole cover assembly 10 includes a moveable cover 14 that can be selectively moved to open and close the frame opening 38, thereby providing selective access to the underlying infrastructure.

In the illustrated embodiment, the cover 14 is generally disc-shaped and includes a cover boss 17 configured to operatively interconnect with the swing assembly 16. The cover 14 includes a main body 70 with an interior face 64 that faces the substructure when the cover 14 is installed on the frame 12. The interior face 64 of the cover 14 includes an outer circumferential margin 65 that rests on the cover support rim 26. The cover 14 also includes an exposed exterior face 65. The exterior face 65 may include treads, lugs, texturing or other surface treatments as desired. For example, the exterior face 65 may include a repeating pattern of protrusions configured to provide improved traction in applications where individuals are likely to walk on the cover 14.

In the illustrated embodiment, the cover boss 17 is generally cylindrical and projects downwardly from the interior face 64 of the cover 14. The cover boss 17 may be shaped to define the cover ramp 18. More specifically, in the illustrated embodiment, the cover boss 17 has an interior end 66 that is sloped with respect to the general extent of the cover 12 to define the cover ramp 18. The cover ramp 18 may slope toward the substructure as the interior end 66 moves in toward the center of the cover 14 (See FIG. 1). The interior end 66 may slope at an angle equal to the slope of the exterior face 52 of the frame ramp 20. The cover ramp 18 is not strictly necessary. In an alternative embodiment, the cover 14 does not include a cover ramp 18. Instead, some portion of the cover 14 or a projection therefrom is disposed adjacent to the frame ramp 20 so as to operatively interface with the frame ramp 20 as the cover 14 swings with respect to the frame 12.

In the illustrated embodiment, the cover boss 17 defines a cover post hole 58. The illustrated cover post hole 58 extends from the interior end 66 of the cover boss 17 partially through the thickness of the cover 14. The cover post hole 58 may be located at or near the center of the cover boss 17 or the part of the cover 14 that interfaces with the frame ramp 20. As illustrated, the diameter of the cover post hole 58 generally matches the diameter of the frame post hole 54. In the illustrated embodiment, the pivot post 82 is threadedly secured to the cover 14 within the cover post hole 58. Accordingly, the internal surface 68 defining the cover post hole 58 is threaded to receive a threaded end of the pivot post 82 as described in more detail below. For example, the cover post hole 58 may be drilled and tapped after molding the cover 14.

In the embodiment of FIGS. 1-5A, the cover 14 includes one or more handles 62 to facilitate opening of the manhole cover assembly 10. The handle 62 may be one or more slots defined through the cover 14. As shown, two handles 62 may be defined in an extension portion 85 extending beyond the general circumference of the cover 14. The extension portion 85 (and accordingly the handles 62) may be located generally opposite the location of the cover boss 17. Alternatively, the handle could be a knob or bar attached to the outer face of the cover.

In applications where a leak-tight seal is desired, the assembly 10 may including a seal 46 and channel 44 in the cover support rim 26, the cover 14 may rest on top of the seal 46. When the cover 14 is in place on the cover support rim 26, the seal 46 is compressed to form a leak-tight seal between the cover 14 and frame 12. Alternatively, the seal 46 (or alternative seal) may be mounted to the cover 14, for example, in a seal receiving channel (not shown) defined in the outer circumferential margin 65.

In one embodiment, the cover 14 is cast from iron, but alternative materials or fabrication methods providing suitable performance could also be utilized.

III. Swing Assembly

As discussed above, the swing assembly 16 rotatably connects the cover 14 to the frame 12. In the embodiment of FIGS. 1-5, the swing assembly 16 includes a pivot post 82 that is fixed to the cover 14 and rotatably received by the frame 12. The swing assembly 16 may optionally a spring 84 and cotter pin 86 as described below.

In the illustrated embodiment, the pivot post 82 includes a first end 88, a midsection 92 and second end 90. The longitudinal axis of the pivot post 82 defines a pivot axis about which the cover 14 rotates. In one embodiment, the first end 88 of the illustrated pivot post 82 is threaded to provide a mechanism for securing the pivot post 82 to the cover 14. The cover post hole 58 threadedly receives the first end 88 of the pivot post 82. Alternatively, the first end 88 may be cast in place in the cover post hole 58. As shown, a composite bushing 98 is disposed in the frame post hole 54. The bushing 98 may reduce friction between the pivot post 28 and the frame post hole 54. The midsection 92 of the pivot post 82 may be substantially smooth and swing freely within the composite bushing 98. In the illustrated embodiment, the swing assembly additionally include a pair of synthetic washers 99, 101 such as Nylatron® washers, disposed about the pivot post 82 between the frame ramp 20 and the cover ramp 18. The washers 99, 101 act to reduce friction between the frame ramp 20 and cover ramp 18. In an alternative embodiment, the assembly 16 may include one or more washers, or no washers at all. In one embodiment, the washers 99, 101 swing freely about the post 82, however, they could be attached to each other, the cover ramp 18 or the frame ramp 20.

The swing assembly 16 may optionally include a spring 84 or other biasing component. In one embodiment, the spring 84 is fitted over the second end 90 of the pivot post 82. In this embodiment, the second end 90 of the pivot post 82 may define a bore 94 through the diameter of the pivot post 82 to receive the cotter pin 86 or other spring 84 securing means. The pivot post 82 may be fabricated from steel, but any material providing suitable performance may be utilized. In the illustrated embodiment, the spring 84 is a compression spring. However, the compression spring 84 may be replaced by alternative biasing components. In the illustrated embodiment, the cotter pin 86 extends through the bore 94 in the pivot post 82 and holds the spring 84 in compression against the interior face 50 of the frame ramp 20. Various alternative spring securing means are suitable for use and are well-known in the art. In use, the spring 84 biases the cover 14 in the closed position and provides tactile indication to the operator when the cover 14 is in the closed position. The strength of the spring is selected to provide the cover 14 with the desired bias and the desired resistant to rotation.

In an alternative embodiment, the pivot post may be fixed with respect to the frame instead of the cover. In another alternative embodiment, the swing assembly is a rotational interface between the cover and the frame. In other words, the geometry of the cover and frame interfit to promote rotational motion between the cover and the frame. In still further embodiments, the swing assembly may be any suitable rotational linkage between the frame and cover.

IV. Optional Lock Assembly

In the illustrated embodiment, the manhole cover assembly 10 includes a locking mechanism 74 to prevent unauthorized access to infrastructure beneath the manhole cover assembly 10. Various locking mechanisms are well-known in the art and will be recognized by those skilled in the art. In one embodiment, the locking mechanism 74 includes a cover lock interface 76, a frame lock interface 78 and a lock 80. The cover lock interface 76 may be a hole defined through the outer circumference 65 of the cover 14 beyond the area of the cover 14 in contact with cover support rim 26. The frame lock interface 78 may also include a hole through the outer face 25 of the frame 12 beyond the cover support rim 26. In this embodiment, when the cover 14 is closed over the frame 12, the cover lock interface 76 aligns with the frame lock interface 78. To secure the manhole cover assembly 10, a lock 80 may be inserted through both the cover lock interface 76 and the frame lock interface 78 and secured. Essentially, any type of lock 80 may be utilized for the locking mechanism 74. In the illustrated embodiment, a padlock 80 is used and the shank of the padlock 80 is fitted through the cover lock interface 76 and the frame lock interface 78.

V. Operation

Figure 4:
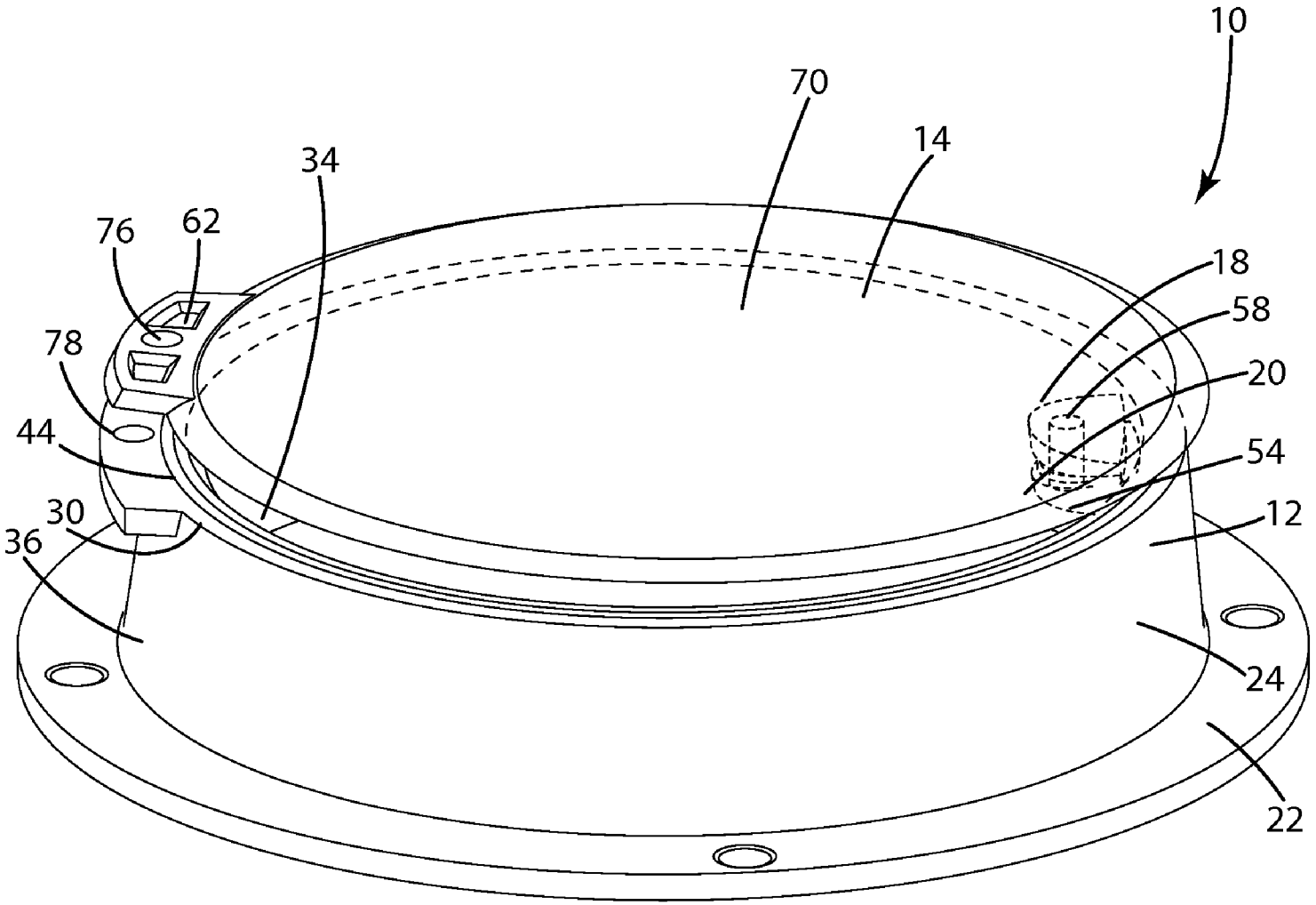
FIG. 4 is a perspective view of a partially open swing-out manhole cover assembly.
Figure 4A:
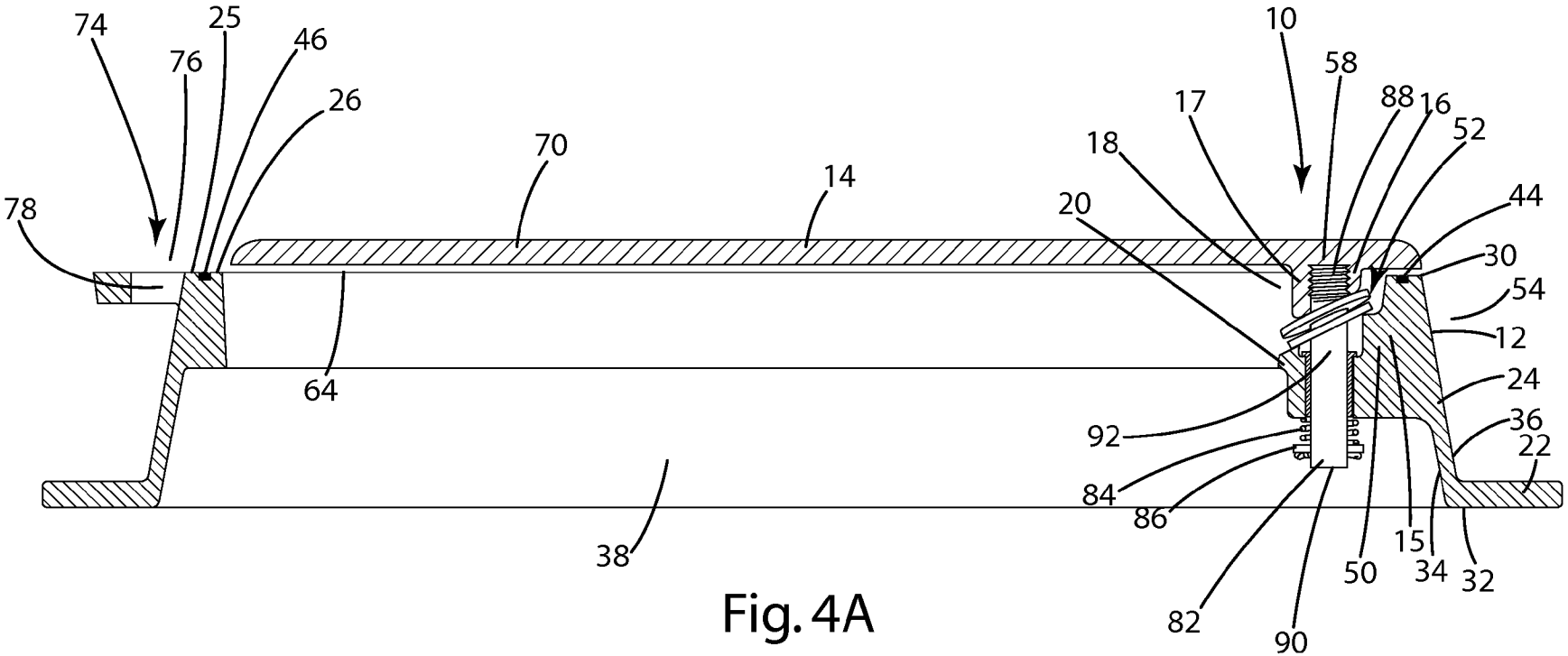
FIG. 4A is a cross-section view of the partially open swing-out manhole cover assembly of FIG. 4.
Figure 5:
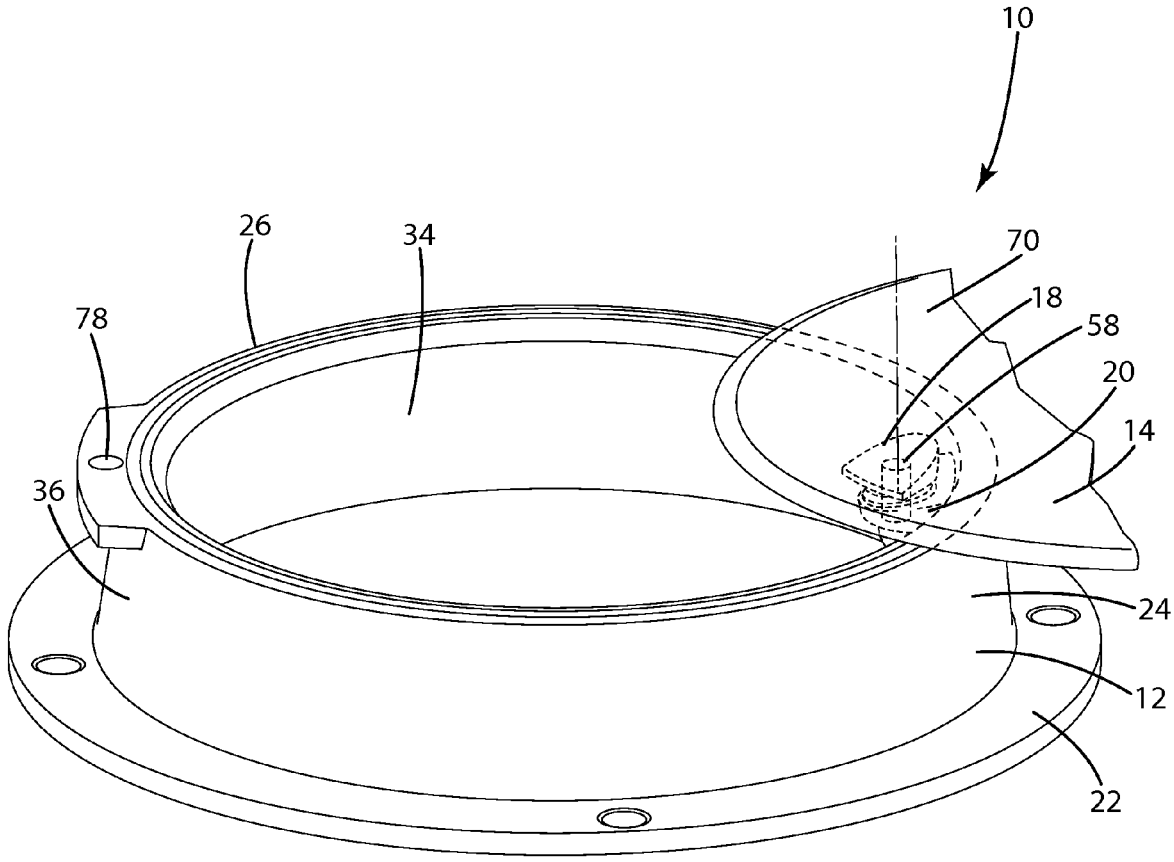
FIG. 5 is a perspective view of an open swing-out manhole cover assembly.
Figure 5A:
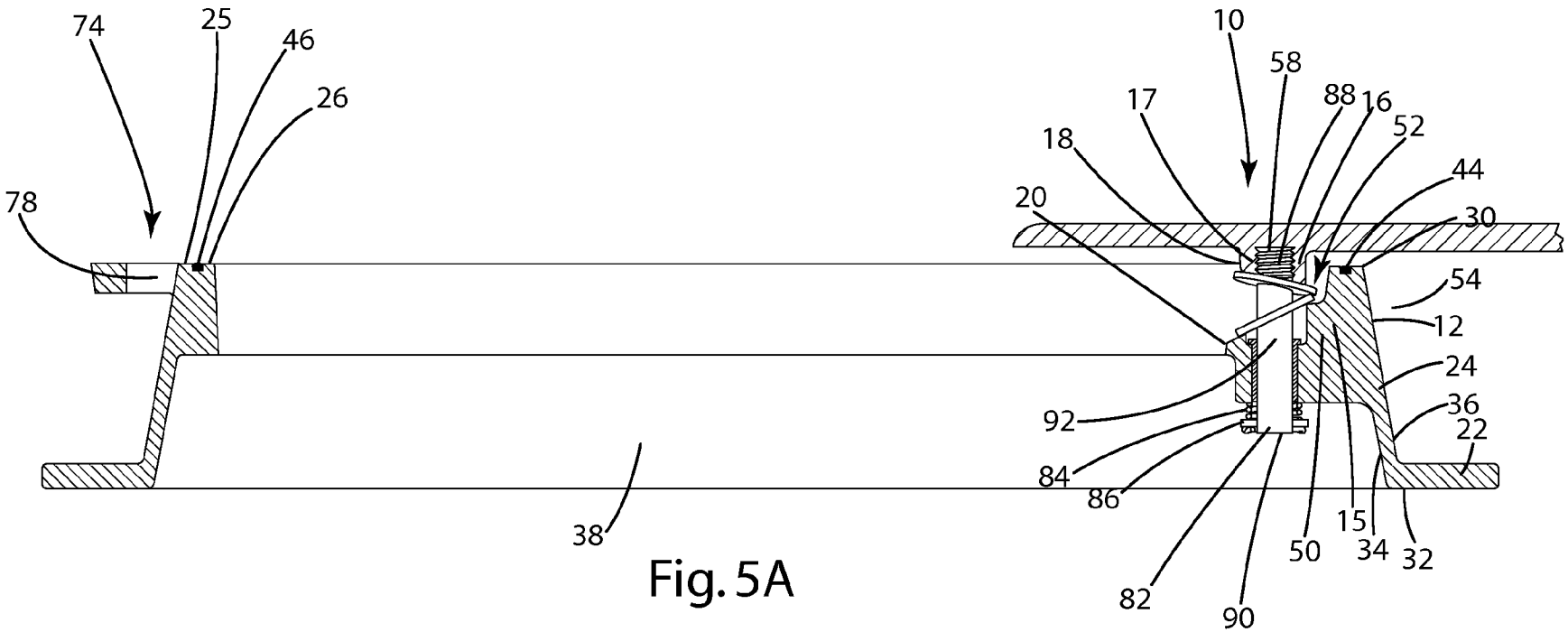
FIG. 5A is a cross-section view of the open swing-out manhole cover assembly of FIG. 5.

Operation of the manhole cover assembly 10 will now be described with reference to the embodiment of FIGS. 1-5A. In embodiments including a locking mechanism 74, the operator disengages the locking mechanism 74 prior to opening the cover 14. To open the cover 14, the operator applies force to the cover 14 tangentially, parallel to the plane of the cover 14. In embodiments including a pivot post 82, the cover 14 and pivot post 82 pivot about the pivot axis with the respect to the frame 12 as the cover 14 begins to swing away from the cover support rim 26. In embodiments utilizing both a cover ramp 18 and a frame ramp 20, and including washers 99, 101, as the cover 14 swings out, the washers 99, 101 ride against each other and the cover ramp 18 rides up the frame ramp 20, separating the cover 14 from the frame 12 slightly, and allowing the cover 14 to swing open more easily. For instance, as shown in FIGS. 4 and 4A, the partially open cover 14 begins to separate from the frame 12, and as shown in FIGS. 5 and 5A, the open cover 14 is separated from the frame 12 by enough distance to allow the cover 14 to swing freely above the frame 12 with a gap between the interior surface 64 of the cover 14 and the first end 30 of the frame wall 24. In embodiments including a seal 46, the separation of the cover 14 from the frame 12 may limit damage to the seal 46 that could occur if the cover 14 scraped over the seal 46 as the cover 14 is repeatedly opened and closed.

In embodiments utilizing only a frame ramp 20, as the cover 14 rotates open away from the frame 12, a portion of the cover 14 or a protrusion therefrom rides against the frame ramp 20 separating the cover 14 from the frame 12 slightly. In embodiments utilizing only a cover ramp 18, as the cover 14 rotates open away from the frame 12, the cover ramp 20 engages the frame 12 or a protrusion therefrom at points along the cover ramp 20, separating the cover 14 from the frame 12 slightly.

When the cover 14 closes by swinging back in to the frame 12, the cover 14 lowers back down to the frame 12 using the ramp or ramp(s). In embodiments including a spring 84, the spring 84 applies a force along the pivot axis directed toward the substructure the frame 12 is mounted to as the cover 14 rotates closed. This force assists the rotation of the cover 14 about the swing assembly 16 and provides a tactile indication when the cover 14 is in the closed position over the frame 12. This force also biases the cover 14 in the closed position over the frame 12.

The above description is that of the current embodiment of the invention. Various alterations and changes can be made without departing from the spirit and broader aspects of the invention as defined in the appended claims, which are to be interpreted in accordance with the principles of patent law including the doctrine of equivalents. Any reference to claim elements in the singular, for example, using the articles "a," "an," "the" or "said," is not to be construed as limiting the element to the singular.

The embodiments of the invention in which an exclusive property or privilege is claimed are defined as follows:

1. A manhole cover assembly providing access to infrastructure comprising:

a frame defining an opening adjacent to an access point for infrastructure;

a cover having an outer perimeter sized at least as large as the opening of said frame;

a swing assembly rotatably connecting said cover to said frame whereby said cover may be selectively swung with respect to said frame about said swing assembly; and a ramp having a sloping face, said sloping face in communication with one of said cover and said frame to separate said cover from said frame as said cover is rotated with respect to said frame about said swing assembly, wherein said ramp is a frame ramp extending from said frame, said cover engaging said frame ramp through the range of motion of said cover, wherein said frame defines an inner circumferential surface around said opening, said frame ramp extending from said inner circumferential surface and said sloping face providing a sloping surface, wherein said cover has an interior face facing the infrastructure when said cover is installed on said frame, said cover including a projection extending from said interior face of said cover, said projection engaging said frame ramp through the range of motion of said cover, wherein said frame includes a support flange and a frame wall, said support flange resting on the substructure, said frame wall extending from said support flange away from the substructure, said frame wall defining said inner circumferential surface of said frame, wherein said projection is a cover ramp including a second sloping face, said second sloping face of said cover ramp engaging said sloping face of said frame ramp as said cover is rotated about said swing assembly, wherein said second sloping face slopes at an equal angle equal and opposite to said sloping face of said frame ramp, wherein said swing assembly is a pivot post, said pivot post fixedly secured to said cover and rotatably connected to said frame such that said cover and said pivot post rotate with respect to said frame.

2. The manhole cover assembly of claim 1 wherein said pivot post is threadedly secured to said cover.

3. The manhole cover assembly of claim 2 wherein said pivot post hole is located adjacent to said cover ramp.

4. The manhole cover assembly of claim 2 wherein said pivot post is attached to said cover ramp.

5. The manhole cover assembly of claim 4 wherein said pivot post passes rotatably through said frame ramp.

6. The manhole cover assembly of claim 5 further comprising a locking mechanism interconnected between said frame and said cover so as to secure said cover to said frame.

7. The manhole cover assembly of claim 6 further comprising a seal disposed between said frame and said cover.

8. A manhole cover assembly for covering a substructure comprising:

a frame having a support flange, a frame wall and a frame ramp, said frame defining an interior aperture having a center, said support flange configured to abut the substructure, said frame wall extending from said support flange, said frame ramp projecting from said frame wall toward the center of the interior aperture of said frame;

a cover having a cover ramp, said cover ramp positioned adjacent to said frame ramp when said cover is installed on said frame such that as said cover is swung away from said frame, said cover ramp rides against said frame ramp;

a pivot post having a first end and a second end, said first end threadedly secured to said cover, said pivot post rotatably extending through said frame ramp, said cover and said pivot post being rotatable with respect to said frame as said cover is opened;

a spring disposed around said pivot post; and a spring securing means securing said spring around said pivot post.

* * * * *